US007424810B2

(12) United States Patent
Zaccone et al.

(10) Patent No.: US 7,424,810 B2
(45) Date of Patent: Sep. 16, 2008

(54) WASHING MACHINE WITH WATER DIRECTION DEVICE

(75) Inventors: Mark August Zaccone, Louisville, KY (US); Michael Thomas Beyerle, Pewee Valley, KY (US); Paul Michael Hoppe, Louisville, KY (US)

(73) Assignee: General Electric Company, Schenectady, NY (US)

( * ) Notice: Subject to any disclaimer, the term of this patent is extended or adjusted under 35 U.S.C. 154(b) by 368 days.

(21) Appl. No.: 10/868,119

(22) Filed: Jun. 15, 2004

(65) Prior Publication Data

US 2005/0273945 A1 Dec. 15, 2005

(51) Int. Cl.
*D06F 29/00* (2006.01)

(52) U.S. Cl. ..... 68/23.5; 68/207

(58) Field of Classification Search ..... 68/23.5, 68/207

See application file for complete search history.

(56) References Cited

U.S. PATENT DOCUMENTS 4,464,914 A * 8/1984 Torita ..... 68/23.5
4,809,524 A * 3/1989 Sickert et al. ..... 68/148
5,167,722 A 12/1992 Pastryk et al.
5,460,018 A 10/1995 Werner et al.
5,504,955 A 4/1996 Mueller et al.
5,507,053 A 4/1996 Mueller et al.
5,590,552 A * 1/1997 Kim ..... 68/207
5,657,650 A * 8/1997 Lee et al. ..... 68/23.5
5,768,730 A * 6/1998 Matsumoto et al. ..... 8/159
5,937,677 A * 8/1999 Lee ..... 68/23.5
6,029,293 A 2/2000 Paterson et al.
6,351,974 B1 * 3/2002 Lyu et al. ..... 68/148
6,668,410 B2 * 12/2003 Ryu et al. ..... 8/158
6,691,536 B2 2/2004 Severns et al.
7,010,942 B2 * 3/2006 Ryu et al. ..... 68/19
7,263,862 B2 * 9/2007 Lyu et al. ..... 68/23.3
7,263,864 B2 * 9/2007 Lyu et al. ..... 68/148
2007/0107471 A1 * 5/2007 Zaccone et al. ..... 68/6 R

* cited by examiner

*Primary Examiner*—Joseph L Perrin
(74) *Attorney, Agent, or Firm*—George L. Rideout, Esq.; Armstrong Teasdale LLP

(57) ABSTRACT

A washing machine including a tub, a basket rotatably mounted within the tub, and a spraying ring disposed at a top portion of the tub, and including a plurality of nozzles arranged in groups, the nozzles separated by a first distance, the groups separated by a second distance different than the first distance; wherein each of the plurality of nozzles has an opening therein, the openings of the plurality of nozzles of the same group are parallel to each other, and the spray ring is configured to direct water into the tub through the openings.

25 Claims, 16 Drawing Sheets

WASHING MACHINE WITH WATER DIRECTION DEVICE

BACKGROUND OF THE INVENTION

This invention relates generally to washing machines, and, more particularly, to apparatus and methods for reducing water consumption in washing machine rinse cycles.

Washing machines typically include a cabinet that houses an outer tub for containing wash and rinse water, a perforated laundry basket within the tub, and an agitator within the basket. A drive and motor assembly is mounted underneath the stationary outer tub to rotate the laundry basket and the agitator relative to one another, and a pump assembly pumps water from the tub to a drain to execute a wash cycle. See, for example, U.S. Pat. No. 6,029,298.

Traditionally, rinse portions of wash cycles include a deep-fill process wherein articles in the laundry basket are completely submerged in water and the water is agitated. As such, a large amount of water mixes with detergent remaining in the laundry after they are washed. While the concentration of detergent in the water is relatively small, a large amount of detergent can be removed from the laundry due to the large amount of water involved. It has become increasingly desirable, however, to reduce water consumption in washing operations.

At least some types of washing machines have reduced water consumption in rinsing operations by using a re-circulating rinse water flow. In this type of system, rinse water is collected in a bottom of the tub and pumped back to a plurality of spray nozzles located above the basket. The rinse water is re-circulated for a predetermined length of time before being discharged to a drain. See, for example, U.S. Pat. No. 5,167,722. While such systems are effective to reduce water consumption, they increase the costs of a washing machine by employing pumps, conduits etc. that result in additional material and assembly costs.

BRIEF DESCRIPTION OF THE INVENTION

In one aspect, a washing machine is provided. The washing machine includes a tub, a basket rotatably mounted within the tub, and a spraying ring disposed at a top portion of the tub. The spraying ring includes a plurality of nozzles arranged in groups, the nozzles separated by a first distance, the groups separated by a second distance different than the first distance, wherein each of the plurality of nozzles has an opening therein, the openings of the plurality of nozzles of the same group are parallel to each other, and the spray ring is configured to direct water into the tub through the openings.

In another aspect, a washing machine is provided. The washing machine includes a tub, a basket rotatably mounted within the tub; and a spraying device configured to direct water into the tub, the spraying device having a plurality of substantially equally spaced nozzles producing non-overlapping water streams which result in a radial target position around the tub.

In another aspect, a washing machine is provided. The washing machine includes a tub, a basket rotatably mounted within the tub, and a spraying device configured to direct water into the tub, the spraying device having a channel in which a fluid flows and a plurality of spaced nozzles, each of the plurality of nozzles having a boss around an entrance thereof inside the channel.

In another aspect, a washing machine is provided. The washing machine includes a tub, a basket rotatably mounted within the tub, a spray fill conduit disposed at a top portion of the tub and above the basket, the spray fill conduit comprising an outer surface and a channel defined within the spray fill conduit, a plurality of nozzles arranged along the spray ring and formed within the outer surface of the spray fill conduit, each of the plurality of nozzles including a protrusion extending into the channel and a opening defined though the protrusion, and wherein the spray fill conduit is configured to direct water into the tub through the openings of the plurality of nozzles.

In still another aspect, a method for operating a washing machine in a rinse cycle is provided. The washing machine includes a rotatable basket having a sidewall, a water spraying device, and a water valve coupled to the water spraying device. The method includes spraying a predetermined quantity of water into the basket using the water spraying device while the basket is rotating at the first rate or the basket is stationary, and rotating the basket at a second rate of rotation, the second rate of rotation greater than the first rate of rotation.

DETAILED DESCRIPTION OF THE INVENTION

Figure 1:
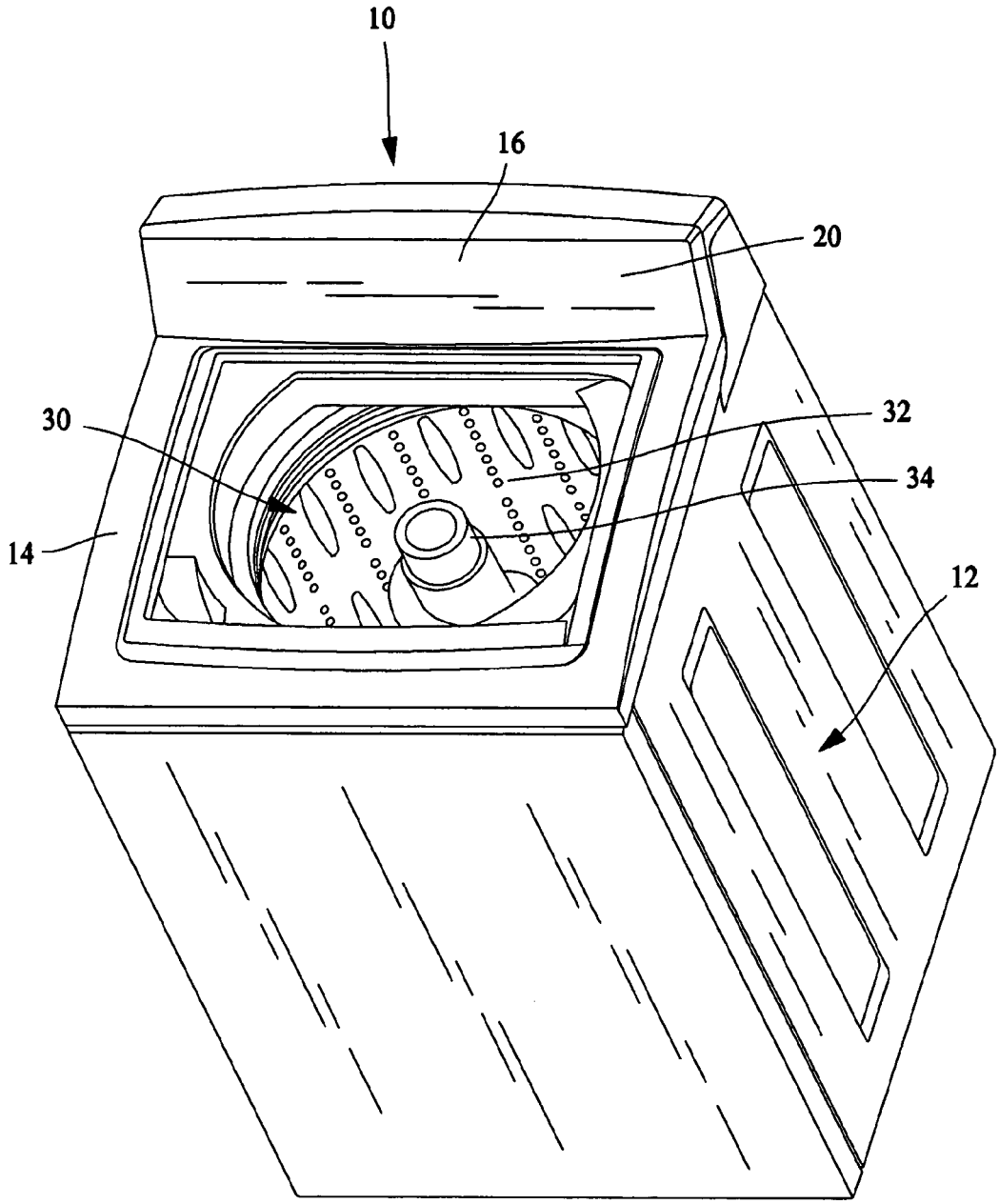
FIG. 1 is a perspective view of an exemplary vertical axis washing machine.

FIG. 1 is a perspective view of an exemplary vertical axis washing machine 10 including a cabinet 12 and a cover 14. A backsplash 16 extends from cover 14, and a variety of appliance control input selectors 20 are coupled to backsplash 16. Input selectors 20 form a user interface input for operator selection of machine cycles and features.

A wash tub 30 is located within cabinet 12, and a wash basket 32 is movably disposed and rotatably mounted in wash tub 30 in a spaced apart relationship from wash tub 30. Basket 32 includes a plurality of perforations therein to facilitate fluid communication between an interior of basket 32 and wash tub 30. A known agitator, impeller, or oscillatory basket mechanism 34 is disposed in basket 32 to impart an oscillatory motion to articles and liquid in basket 32. As illustrated in FIG. 1, agitator 34 is oriented to rotate about a vertical axis. It is contemplated, however, that at least some of the benefits of the present invention may apply to horizontal axis washing machines as well.

Figure 2:
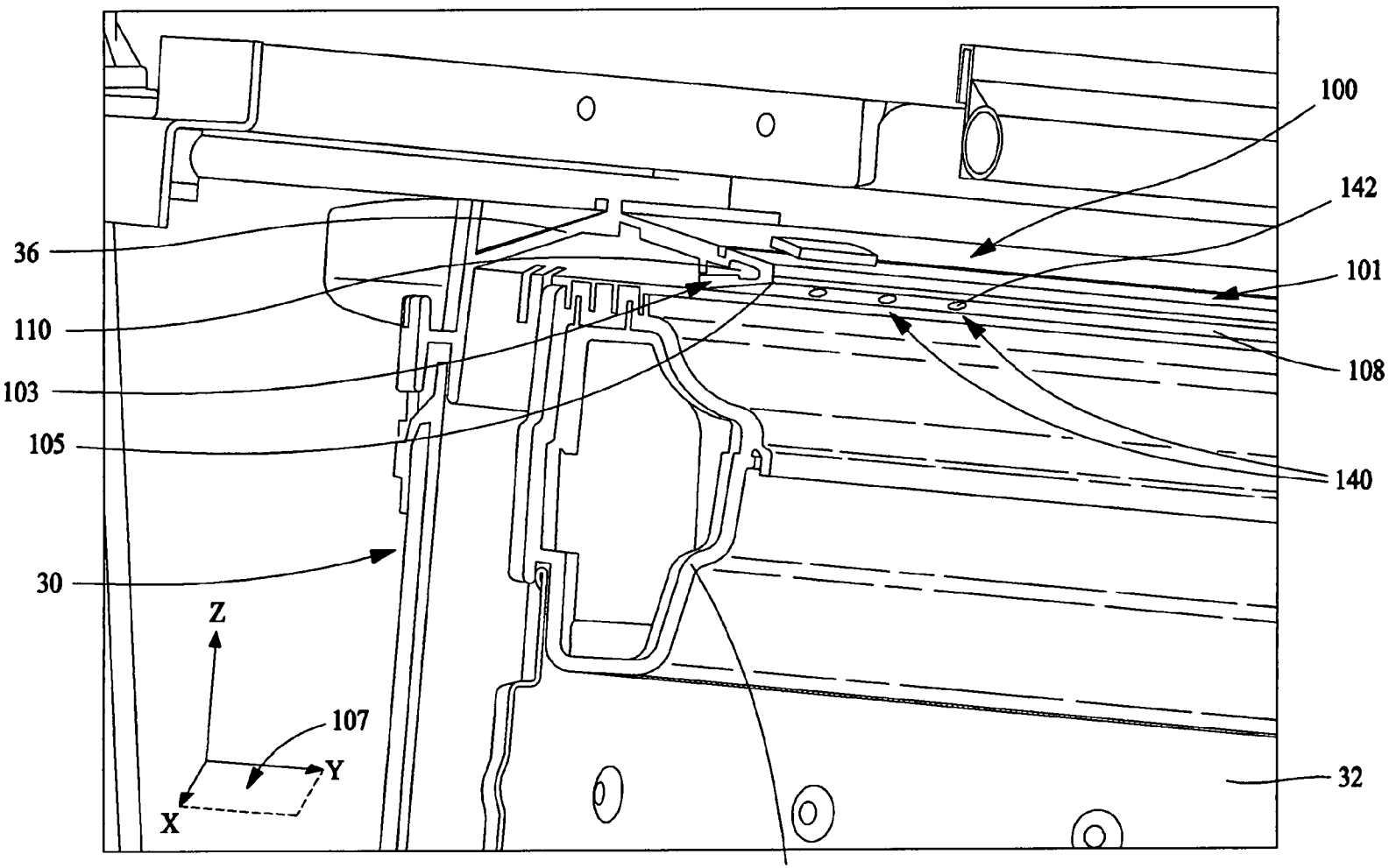
FIG. 2 is a partial and cross-sectional view of a wash tub applicable to washing machine shown in FIG. 1.

FIG. 2 is a partial and cross-sectional view of wash tub 30 applicable to washing machine 10 shown in FIG. 1. Wash tub 30 further includes a tub cover 36 disposed at a top portion of wash tub 30, and a balance ring 38 is mounted within and at a top portion of basket 32 such that balance ring 38 is placed below tub cover 36. A spray ring 100, i.e. a spray fill conduit 100 is mounted at the top portion of wash tub 30, and is configured to direct water into wash tub 30. In an exemplary embodiment, spray ring 100 is attached to a lower surface of tub cover 36, such that tub cover 36 facilitates preventing any possible flood condition which may be caused by clothing deflecting water outside wash tub 30. Alternatively, spray ring 100 can also be arranged above tub cover 36.

Spray ring 100 is substantially triangular in cross section, and includes an upper half 101 and a lower half 103 jointed with upper half 101 by joining methods for plastic, such as heat bonding, vibration welding or adhesive bonding. A ring-shaped channel 110 is defined by upper and lower halves 101 and 103, such that channel 110 is within and along spray ring 100. In an exemplary embodiment, lower half 103 further includes a slant board portion 105 extending at an angle between 17 to 22 degrees with respect to a horizontal plane 107. Board portion 105 at an angle between approximately 17 and approximately 22 degrees enables the water to flow evenly in channel 110, such that a good rinsability is obtained. (Discussed in detail hereinafter).

A plurality of nozzles 140 is disposed on an outer surface 108 of board portion 105, and each nozzle 140 has an opening 142 therethrough. Channel 110 is in flow communication with openings 142, such that spray ring 100 can direct water into water tub 30 through openings 142. Nozzles 140 are disposed below tub cover 36 and above basket 32.

Figure 3:
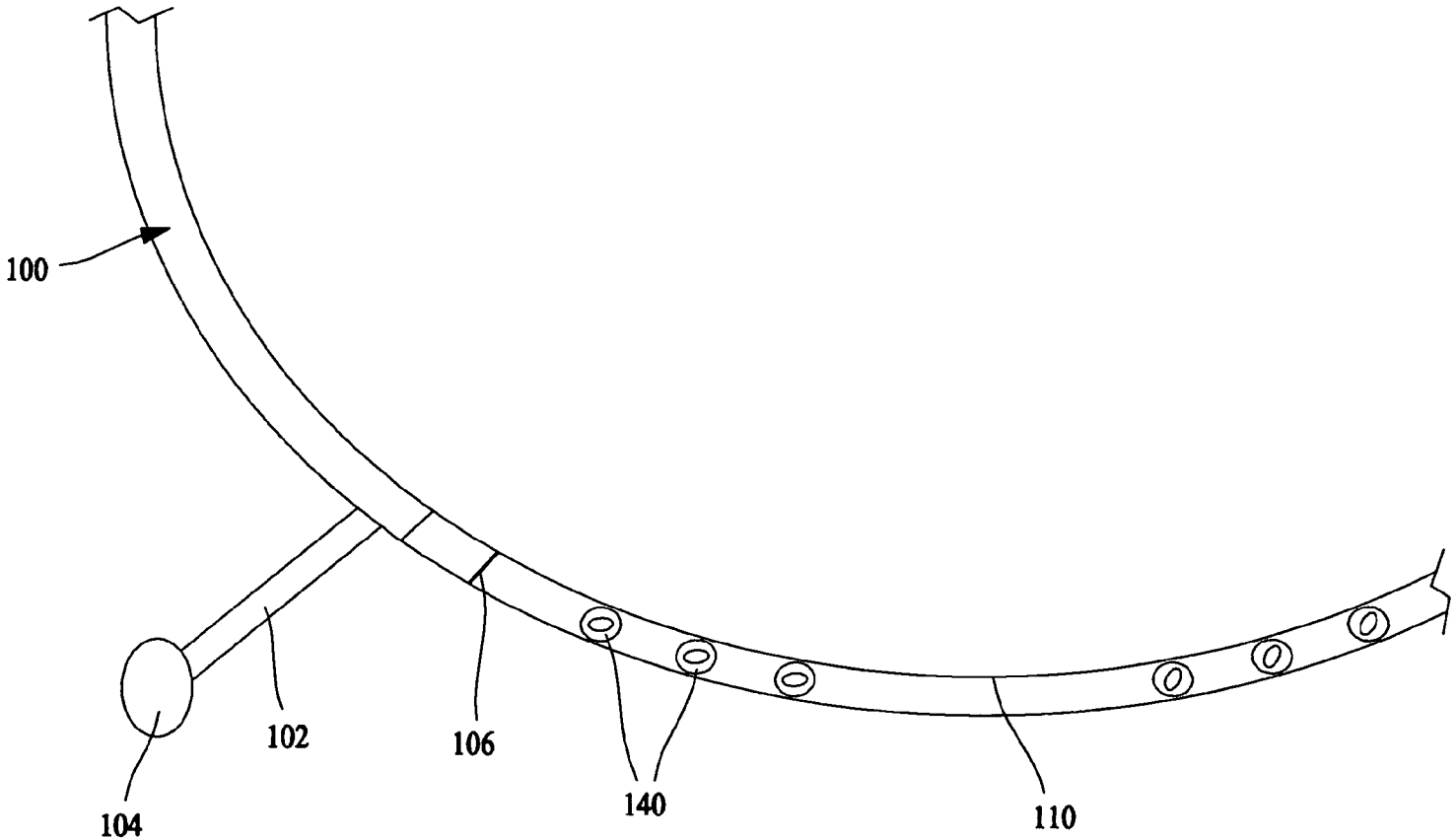
FIG. 3 is a top elevational cutaway view of a spray ring applicable to washing machine shown in FIG. 1.

FIG. 3 is a top elevational cutaway view of spray ring 100 applicable to washing machine 10 shown in FIG. 1. Spray ring 100 further includes an inlet 102 for directing water into channel 110. In an exemplary embodiment, a water valve 104, such as a fixed water valve, or a pulsing water valve, is coupled to inlet 102 such that the flow rate within channel 110 is limited to a predetermined range, which helps to obtain a good rinsability (discussed in detail hereinafter). More specifically, the flow rate is limited within the predetermined range based upon basket geometry. In one exemplary embodiment, the flow rate is between approximately 2.5 and approximately 3.5 gallons per minute.

If water flows in both directions in channel 110, water in channel 110 will flow in the outflow direction of some nozzles 140 and flow against the outflow direction of some of the other nozzles. Accordingly, as water in channel 110 flows with and/or against the direction outflow of different nozzles 140, a variation of flow rates in nozzles 140 is being produced. In an exemplary embodiment, a rib 106 is formed within channel 110 and adjacent to inlet 102 for blocking channel 110, such that water cannot flow in both the clockwise and anti-clockwise directions in channel 110 but such that water flows in either the clockwise or anti-clockwise direction in channel 110. Water flow with or against the direction of the outflow of each nozzle helps to obtain an even flow rate in nozzles 140, and further helps to obtain a good rinsability (discussed in detail hereinafter). More specifically, rib 106 is between inlet 102 and neighboring one of the plurality of nozzles 140. In a further exemplary embodiment, channel 110 is blocked such that water only flows in one direction in channel 110, and the cross sectional area of channel 110 is altered along spray ring 100 to maintain a substantially equal pressure along channel 110.

Figure 4:
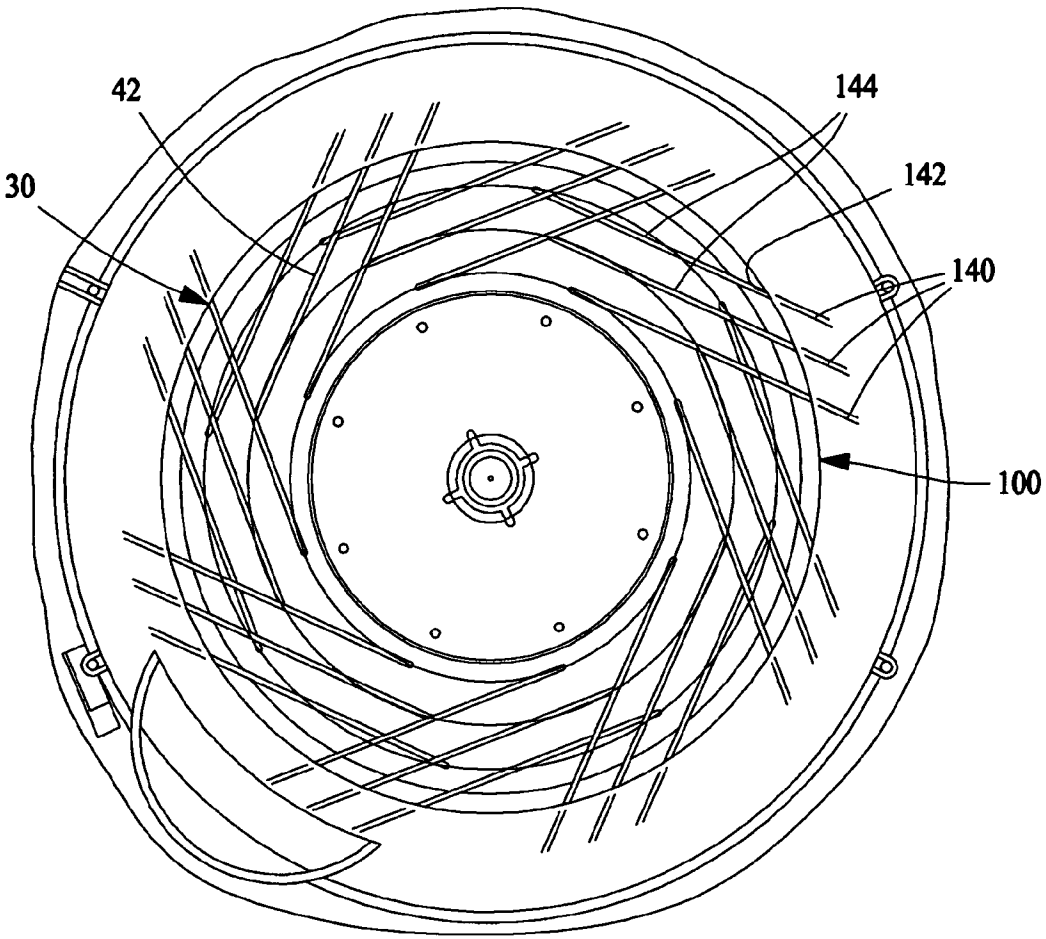
FIG. 4 is a top elevational view of the spray ring mounted on washing machine shown in FIG. 1.
Figure 5:
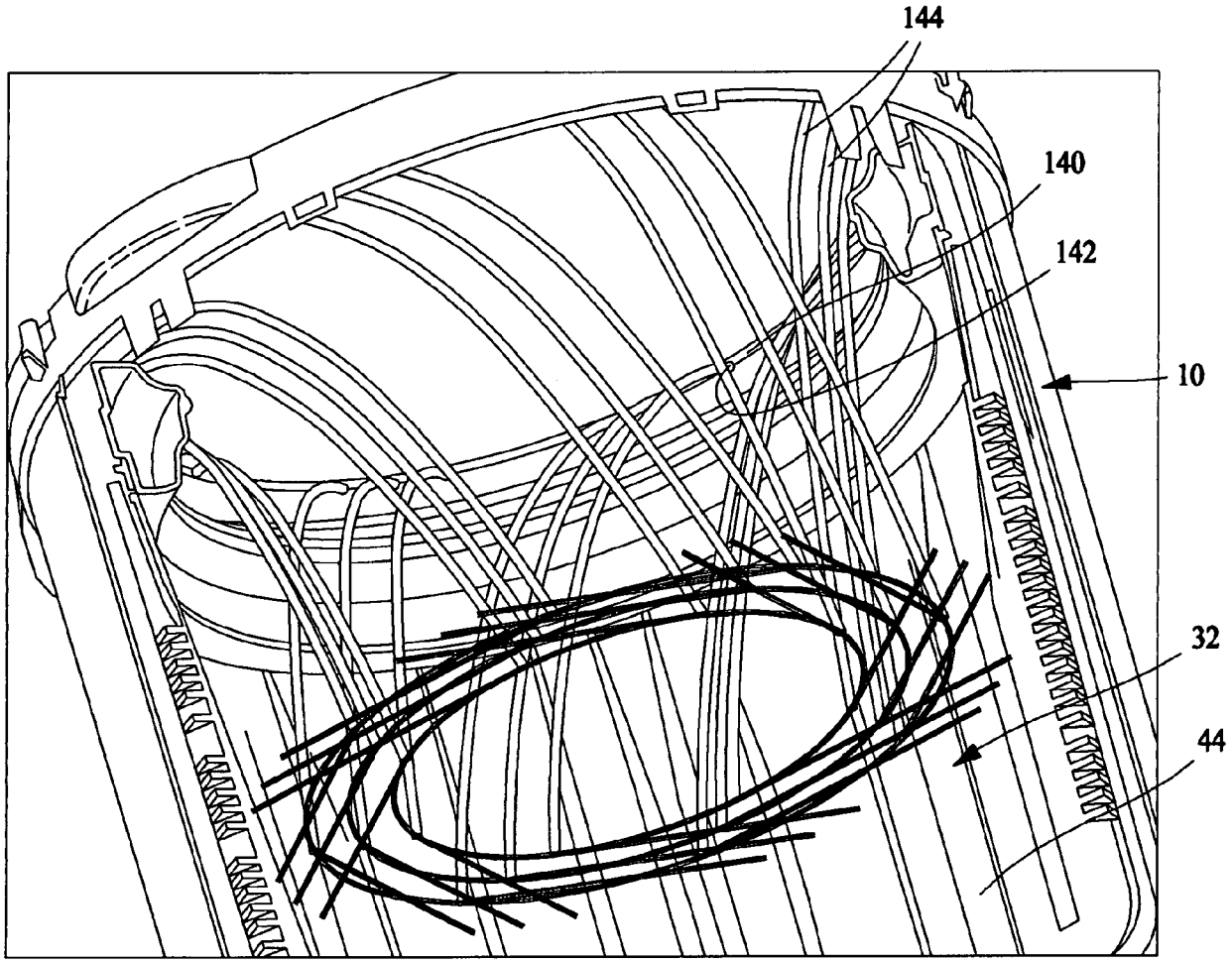
FIG. 5 is a perspective cutaway view of the spray ring mounted on washing machine shown in FIG. 1.

FIG. 4 is a top elevational view of spray ring 100 mounted on washing machine 10 shown in FIG. 1, and FIG. 5 is a perspective cutaway view of spray ring 100 mounted on washing machine 10 shown in FIG. 1. In an exemplary embodiment, the plurality of nozzles 140 is arranged in groups. Each group is spaced at a predetermined distance with one another, such that nozzle groups are substantially evenly arranged along spray ring 100. More specifically, there are 24 nozzles 140 arranged in 8 groups, and each group includes 3 nozzles 140. Openings 142 of nozzles 140 of the same group are parallel to each other, such that openings 142 of nozzles 140 of each group have the same direction. Due to the same configuration and same direction of nozzles 140 of the same group, nozzles 140 of the same group can be manufactured by a single cam (not shown) in molding, which helps to reduce the cost and components in spray ring manufacture.

Nozzles 140 channel water into wash tub 30 in a non-overlapping manner. More specifically, each nozzle 140 channels water to a location within a space approximately 10 inches upward from a bottom wall 42 of basket 32 and approximately 4 inches inward from a sidewall 44 of basket 32. The space is generally the location of the laundry after wash spin is completed, such that water directed by each nozzle 140 can impinges on the laundry to facilitate achieving a good rinsability and avoiding water waste. Each nozzle 140 directs water forming a trajectory 144, and trajectories 144 of nozzles 140 of the same group are substantially parallel with respect to each other.

Openings 142 of each nozzle 140 extend at an angle between a predetermined range with respect to horizontal plane 107. For example, positioning nozzle 140 at an angle less than the predetermined range may result in trajectory 144 being too sensitive to water flow rate such that nozzle 140 may direct water into basket 32 too far away from a predetermined location due to flow rate variation, whereas, an angle greater than the predetermined range may result in relatively high water velocities resulting in water splashing out of water tub 30. In one embodiment, the predetermined angle is between approximately 10 and approximately 45 degrees with respect to horizontal plane 107. In another embodiment, the predetermined angle is approximately 25 degrees with respect to horizontal plane 107. The plurality of nozzles 140 also facilitate directing water into wash tub 30 in a non-radial direction with respect to wash tub 30. Accordingly, and in the exemplary embodiment, openings 142 of each nozzle 140 extend at an angle not less than approximately 30 degrees with respect to outer surface 108 (shown in FIG. 2). During operation, known spray rings require a relatively large quantity of water to adequately rinse the laundry due to a portion of the water adhering to a surface of the spray ring and then falling into tub 30 without contacting the laundry. Whereas, spray ring 100 facilitates directing the water away from outer surface 108 of spray ring 100 thus reducing a quantity of water used to rinse the laundry.

Because the flow rate is limited to a predetermined range, the water is substantially evenly flowing in channel 110, and the flow rate in each nozzle 140 is kept substantially even. Having substantially even flow rates at each nozzle 140 helps each nozzle 140 to direct water to the predetermined position, and helps to avoid directing water to the wrong location caused by flow rate variation around spray ring 100 or in different nozzles 140. By avoiding directing water to the wrong location, water waste caused by directing water to the wrong location is avoided. 24 dispersed nozzles 140 in 8 groups around spray ring 100 can direct water to hit 3 substantial radial locations 8 places around basket 32, which helps to obtain a good rinsability. In an exemplary embodiment, due to the good rinsability achieved by such rinse pattern, basket 32 can spin in a speed less than 150 revolutions per minute when spray ring 100 directs water for rinsing. More specifically, basket 32 can be rotated in a speed less than 80 revolutions per minute when spray ring 100 directs water for rinsing. In another exemplary embodiment, basket 32 is kept stationary when spray ring 100 directs water for rinsing, which helps to avoid the requirement for a multi-speed driven system and lowers the cost.

Figure 6:
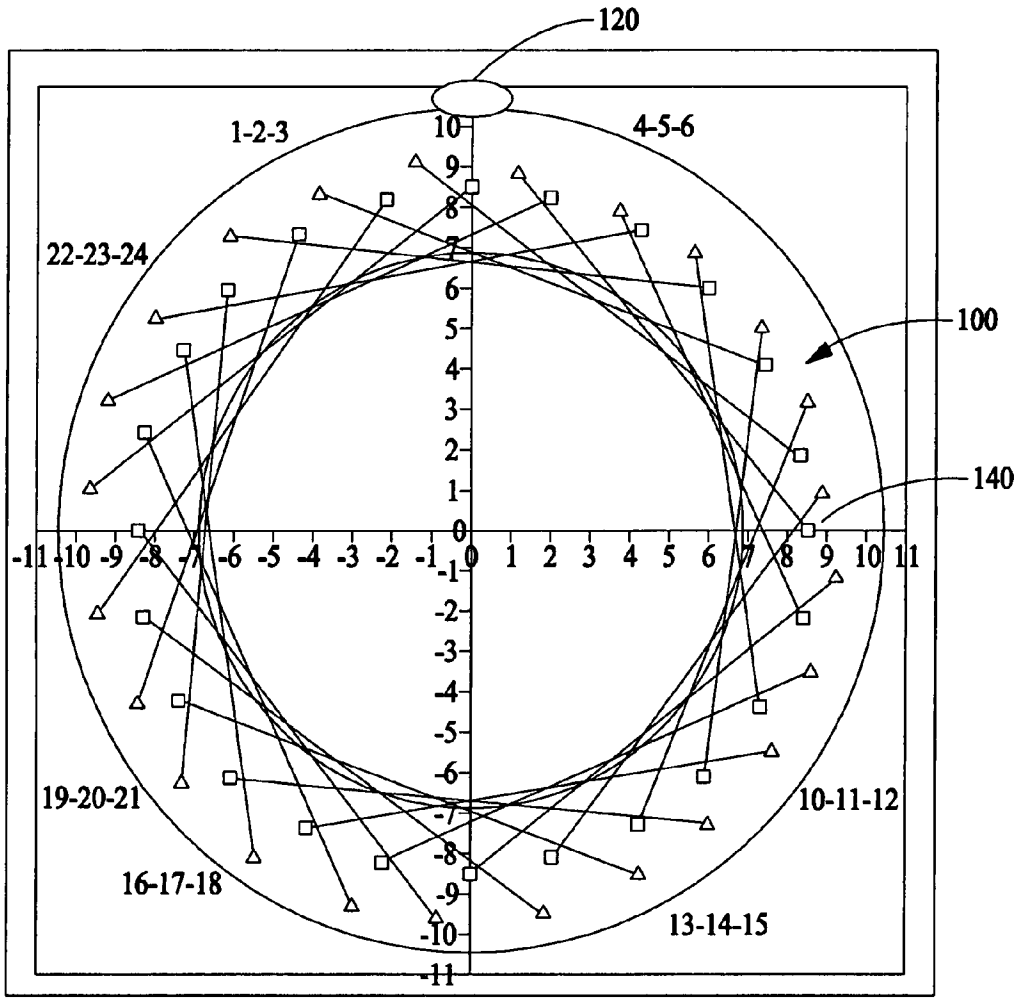
FIG. 6 is a schematic cross-sectional view of a spray ring with a plurality of nozzles in an alternative embodiment.

FIG. 6 is a schematic cross-sectional view of spray ring with a plurality of nozzles in an alternative embodiment. Twenty four nozzles 140 are evenly spaced around spray ring 100, instead of twenty four nozzles 140 arranged in eight groups (shown in FIG. 4). An adjustable water valve 120 is operatively coupled to spray ring 100 to control flow rate. In a predetermined range of flow rate, nozzles 140 can produce non-overlapping streams at different positions in tub 30 which result in a radial pattern on the laundry volume.

After a rinse cycle, the water will be spun out. After the spin the relative location of the basket is at a different position tot he spray ring compared to the first rinse. When another rinse cycle is initiated water hits another twenty four positions on the laundry volume which are different from last rinse cycle. By pulsing or changing the flow rate with valve 120, the complete laundry load can be covered as the radius varies around with flow rate changes. Rinsability is thus achieved without rotating the basket by not overlapping the streams, providing radial coverage on the laundry volume and selecting a number of strike locations which are randomly hit around the tub in 24 places per rinse.

While nozzles 140 are described for purpose of illustration here, it is contemplated that the number and distribution of nozzles 140 can be modified without departing from the scope of the instant invention. The basket is stationary in an illustrative embodiment when spraying ring is initiated to obtain spray coverage of the entire basket, it is appreciated that in alternative embodiments basket 36 is spun at low speed.

Figure 7:
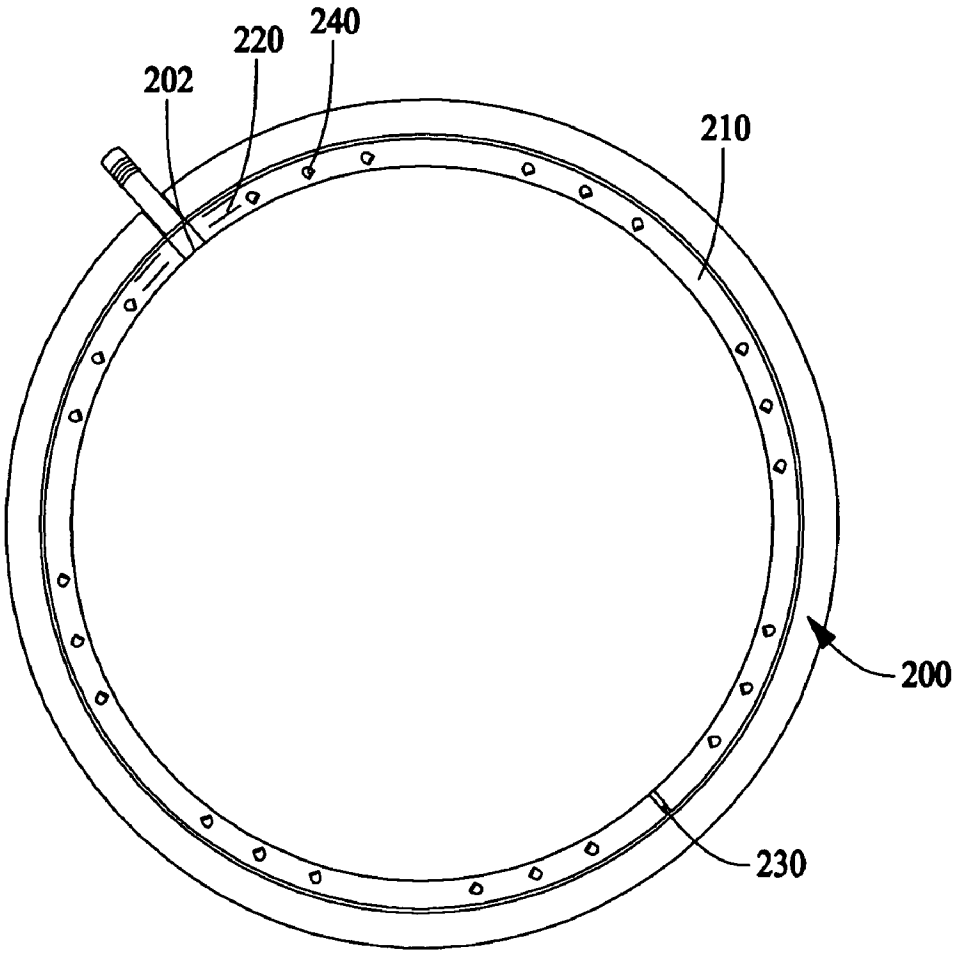
FIG. 7 is an illustrated top view of a spray ring in an alternative embodiment.

FIG. 7 is an illustrated top view of a spray ring 200 in an alternative embodiment. Spray ring 200 is also applicable to washing machine 10 (shown in FIG. 1) in lieu of spray ring 100. Spray ring 200 includes a channel 210 for a flow and a plurality of nozzles 240 arranged in channel 210. An inlet 202 for entering water is defined at a specific position of spray ring 200 which is in a flow communication with channel 210. A pair of parallel baffles 220 extends from an inside surface 260 of channel 210 at each side of inlet 202 to reduce turbulence and recirculation and add robustness to the flow in channel 210. A rib 230 extends from inside surface 260 of channel 210 at a position substantially opposite to inlet 202, in other words, rib 230 and inlet 202 is substantially in a line with the center of spray ring 200. Thus, channel 210 is separated into two symmetrical channels into which water flows from inlet 202 along two contrary directions, i.e., clockwise and counterclockwise, respectively.

Figure 8A:
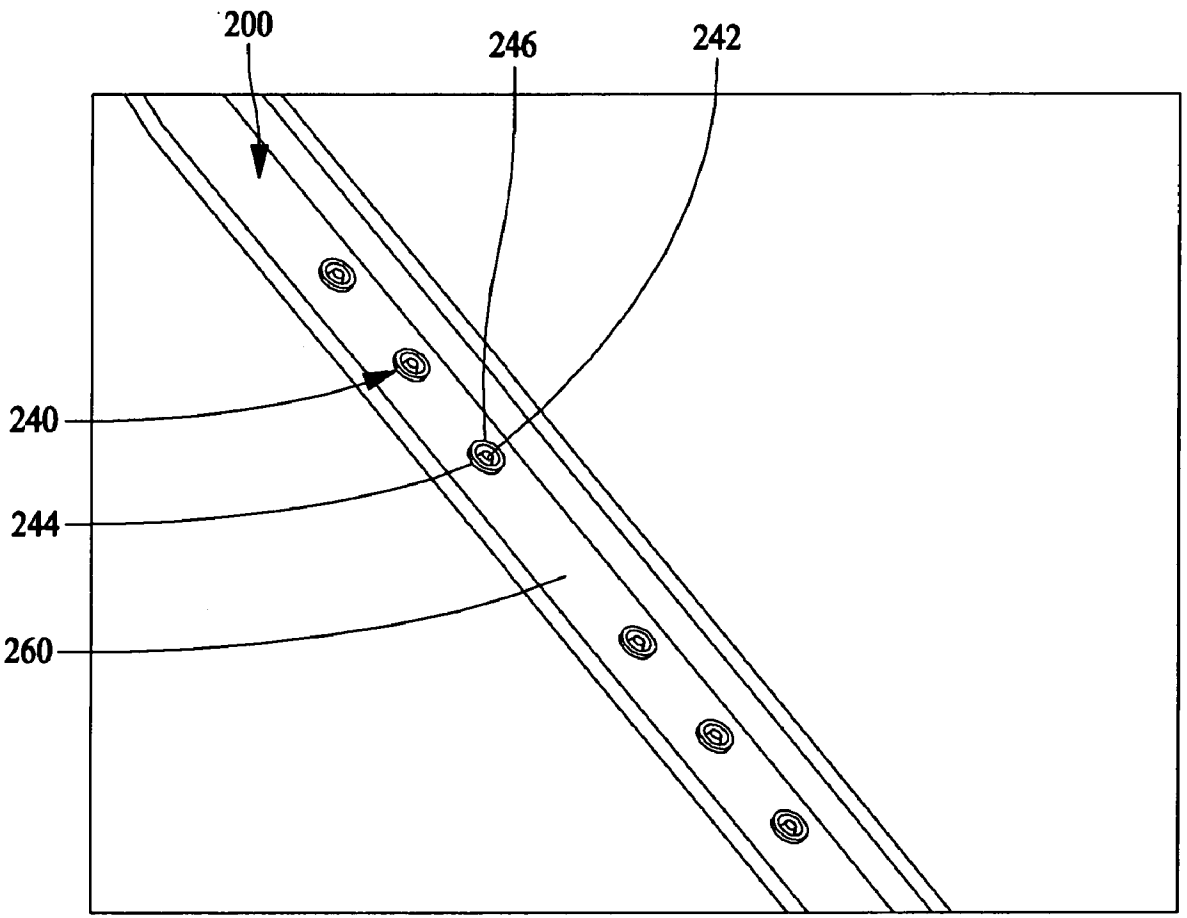
FIG. 8*a* is an illustrated partially enlarged view of the spray ring of FIG. 7.
Figure 8B:
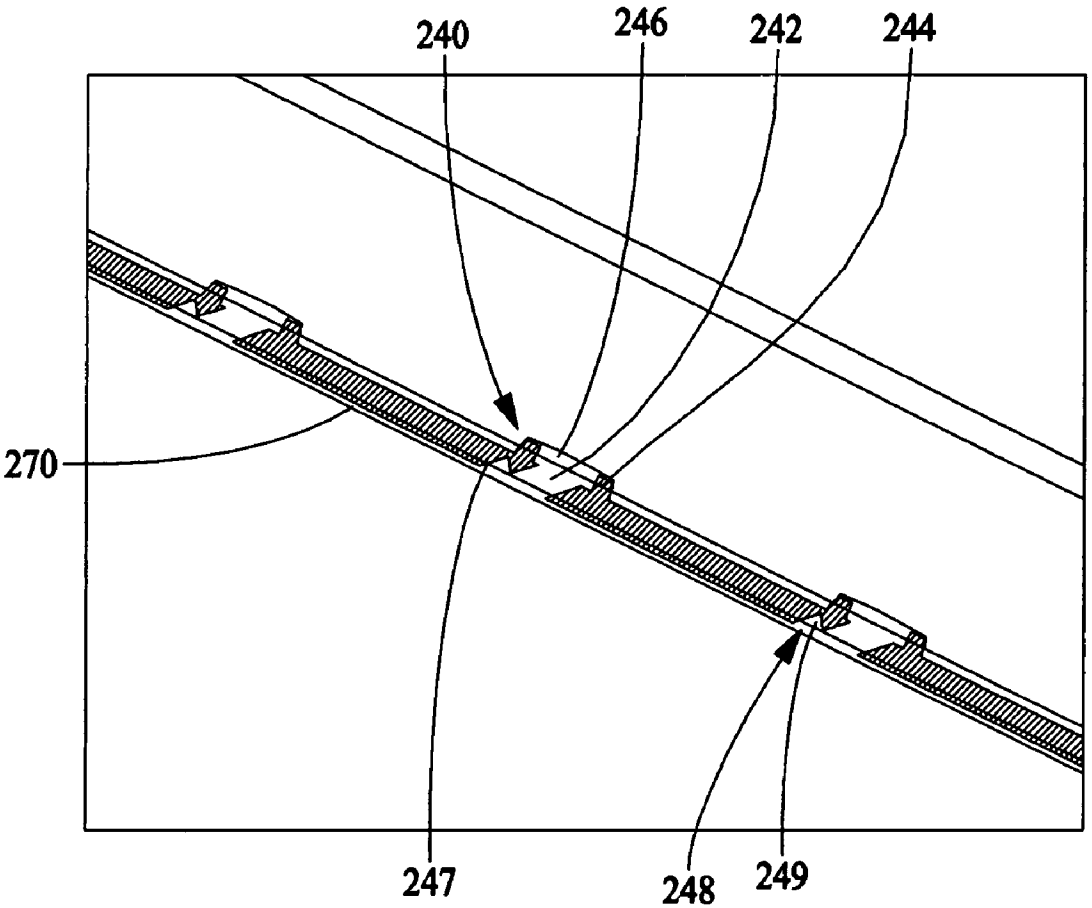
FIG. 8*b* is a cross sectional view of the spray ring of FIG. 8*a*.

FIG. 8*a* is an illustrated partially enlarged view of spray ring 200, and FIG. 8*b* is a cross sectional view of spray ring 200 of FIG. 8*a*. The plurality of nozzles 240 is in eight groups, three nozzles in each group. Nozzles 240 in each group are parallel to each other such that they can be manufactured with one cam action during injection molding. The plurality of nozzles 240 extends from inside surface 260 of channel 210 through a lower half (not labeled) of spray ring 200, as described above. Each nozzle 240 has a certain length to channel the flow along a desired trajectory, for example, at least 0.09 inches.

Each nozzle 240 includes an opening 242, a boss 244 circumscribing opening 242, and a counterbore 246 at least partially extending through boss 244. An undercut 248 is defined in an outer surface 270 by a top wall 247 and a declining side wall 249. Opening 242 is in communication with counterbore 246 and undercut 248. Opening 242 is defined at a specific declining angle away from inside surface 260 of spray ring 200, as above described. Boss 244 has a predetermined height to facilitate changing a direction of the water flow regardless of the direction of opening 242. In one embodiment, boss 244 has a perimeter having at least one of an elliptical and a circular cross-sectional shape. In another embodiment, boss 244 has an outer perimeter having a shape substantially similar to a shape of an outer perimeter of opening 242. In the exemplary embodiment, the diameter of opening 242 is approximately 0.1 inches less than a diameter of counterbore 246. Top wall 247 which forms undercut 248, adjacent to an exit end (not labeled) of nozzle 240, is substantially perpendicular to a vertical axle (not labeled) of nozzle 240 to eliminate water adhering to outer surface 270 of spray ring 200 due to surface tension effect.

Figure 9A:
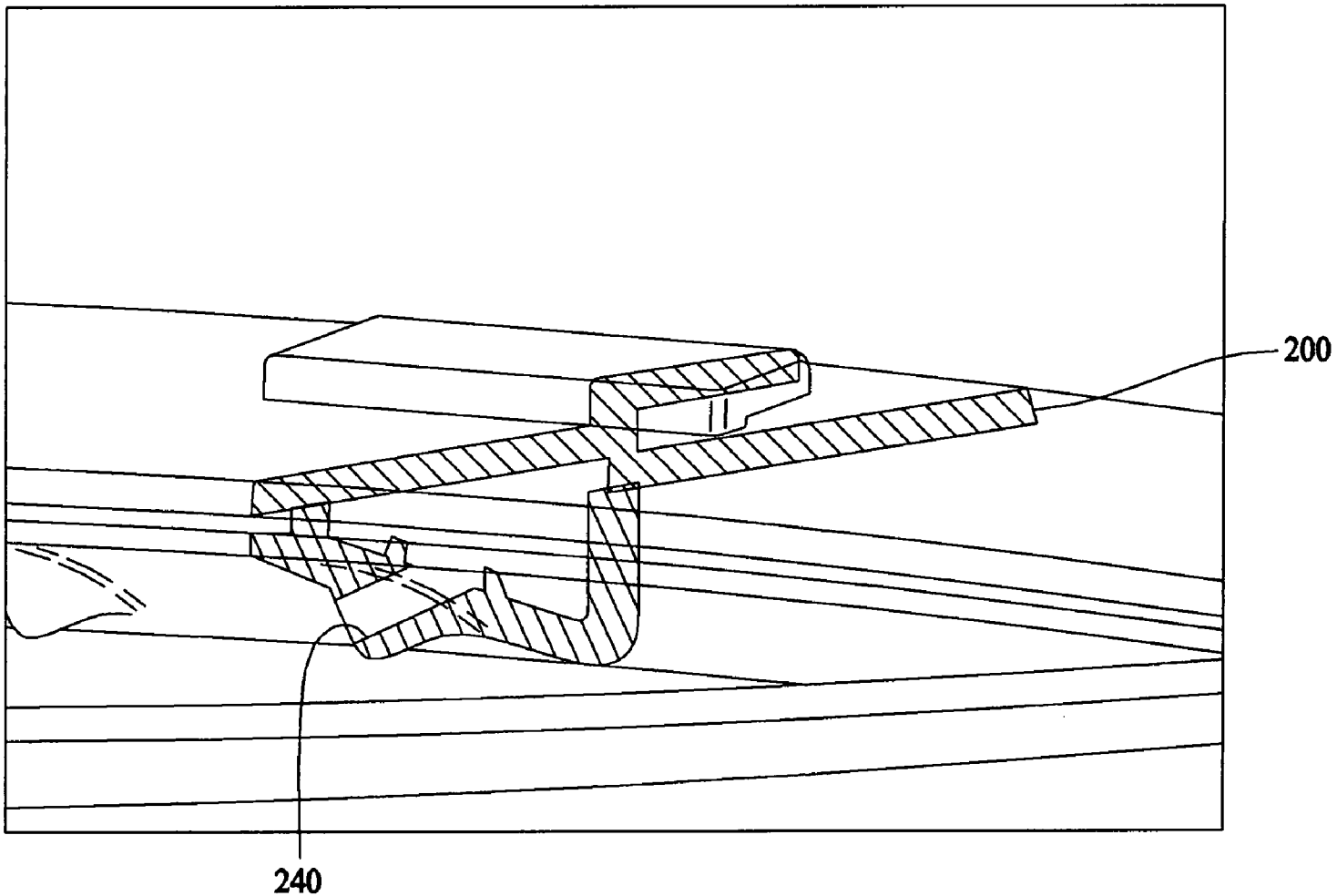
FIG. 9A is a schematic view of an alternative embodiment of the spray ring of FIG. 7.
Figure 9B:
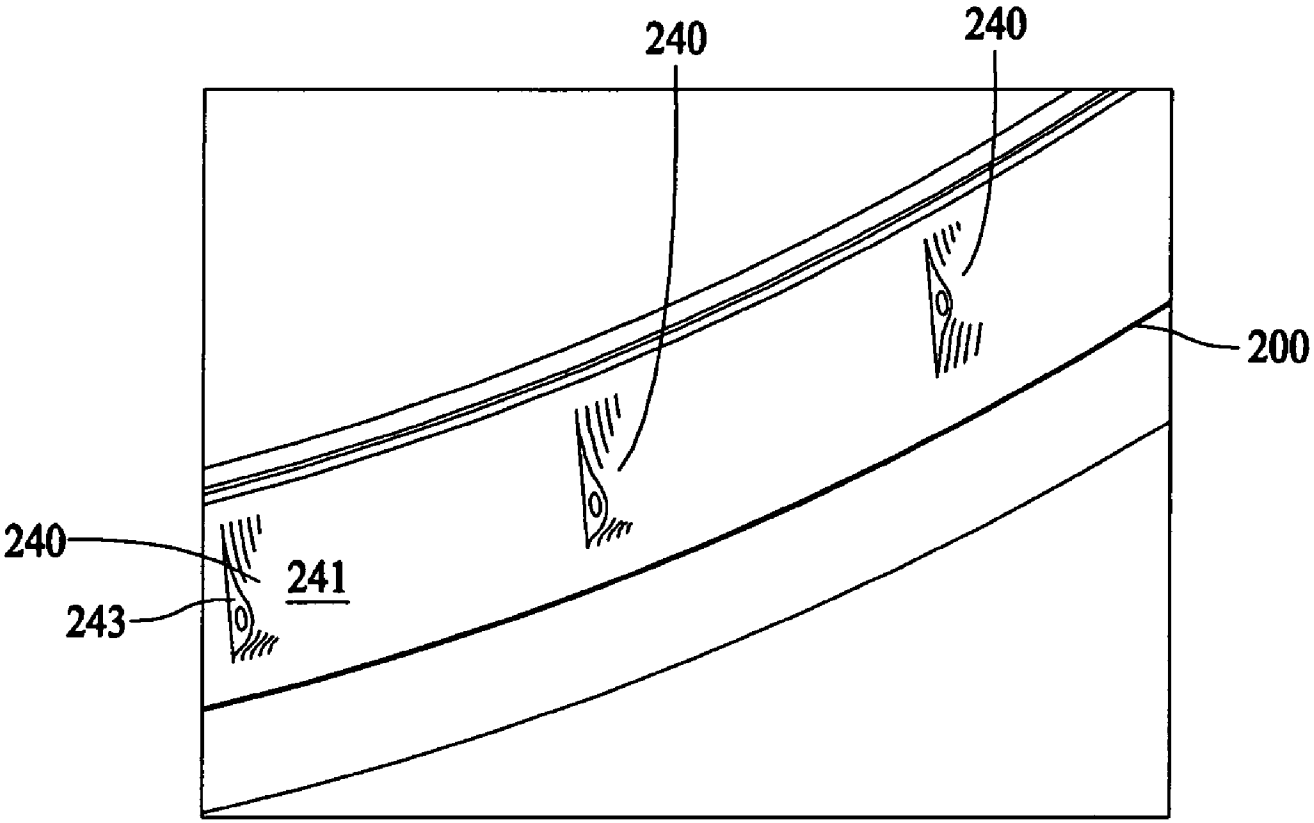
FIG. 9B is a perspective view of the spray ring of FIG. 9A.

Since boss 244 is circumscribes opening 242, the water enters opening 242 along a direction perpendicular to inside surface 260 of the lower half of spray ring 200 such that water flows through nozzles 240 the same direction regardless of the flow, (i.e. clockwise and counter-clockwise). FIG. 9A is a schematic view and FIG. 9B is a perspective view of an alternative embodiment of spray ring 200 including at least one extended nozzle 240 that extends toward a central axis (not labeled) of basket 32. Nozzles 240 include a sloped side 241 and an outlet side 243. In an exemplary embodiment, nozzles 240 are positioned in the spin direction such that laundry will not contact outlet side 243 but may contact sloped side 241 during a spin cycle.

Figure 10:
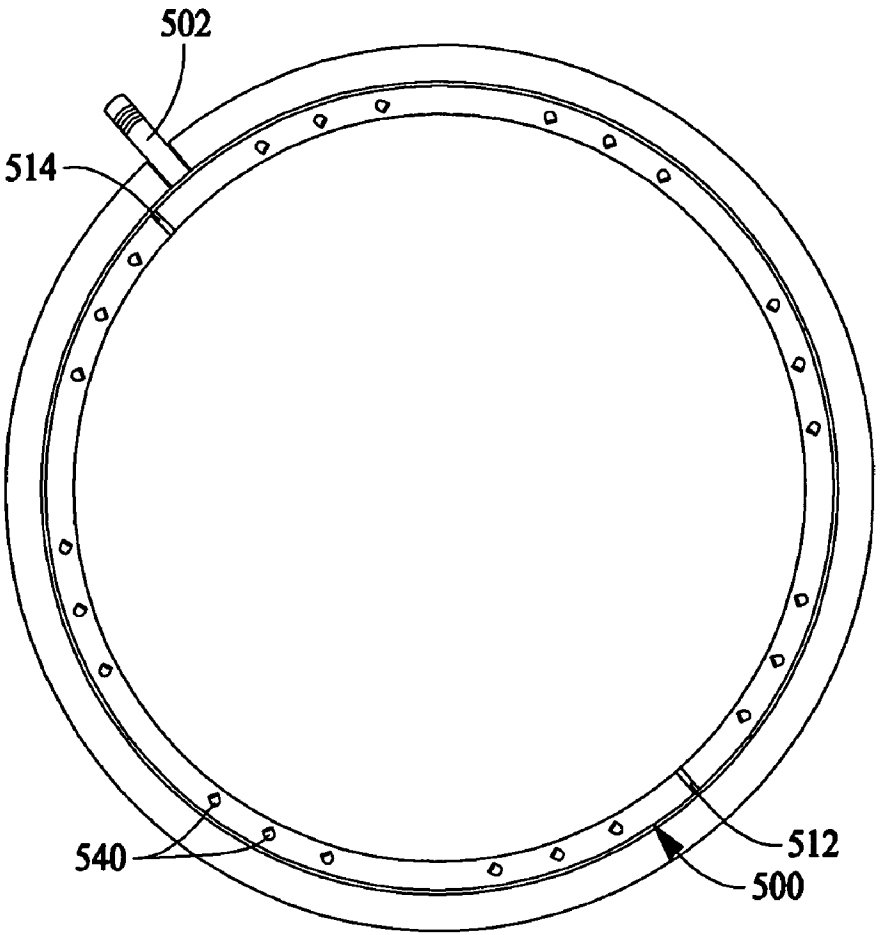
FIG. 10 is an illustrated bottom view of a spray ring in an alternative embodiment.
Figure 11:
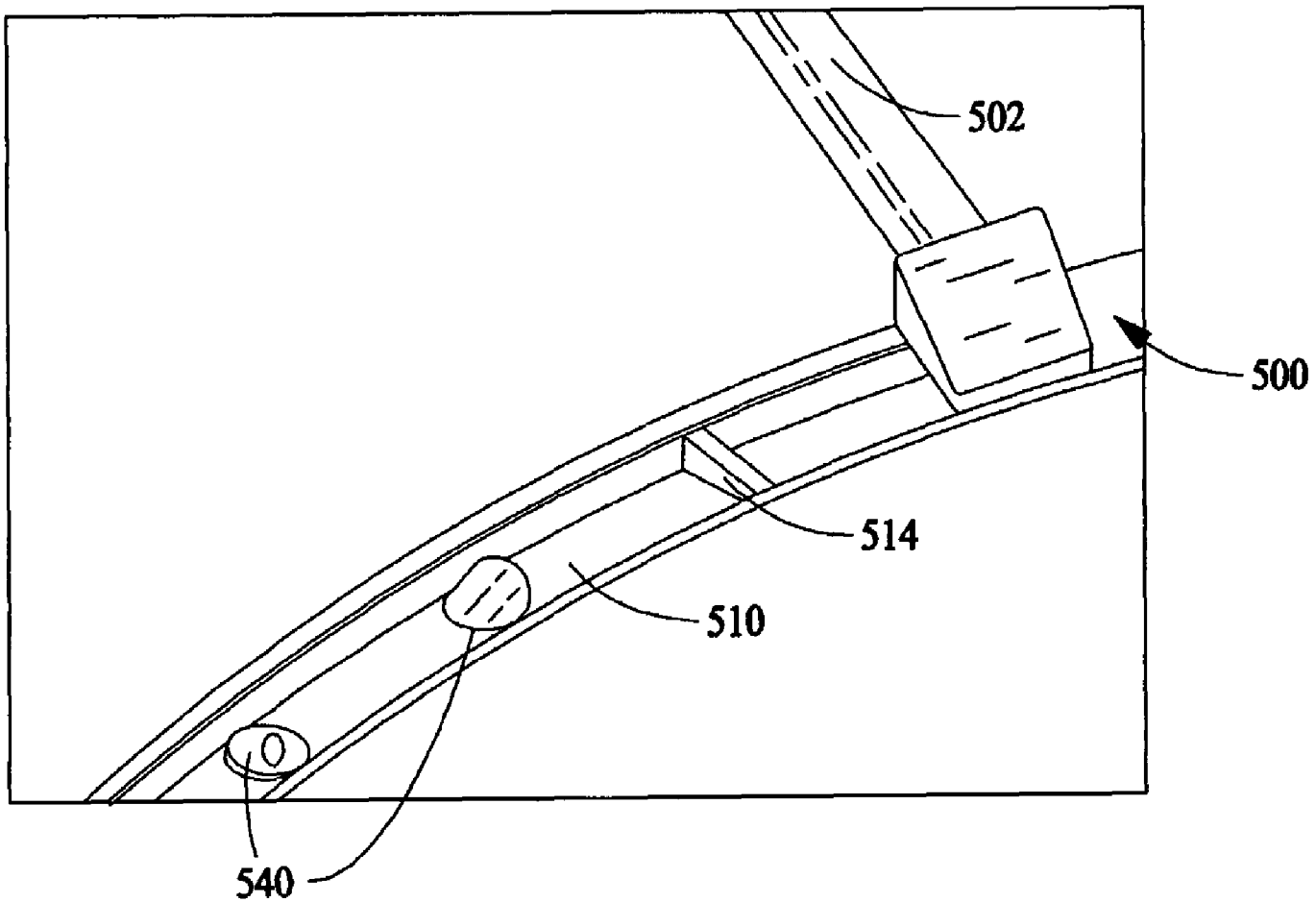
FIG. 11 is an enlarged partial view of the spray ring shown in FIG. 10.

FIG. 10 is an illustrated top view of a spray ring 500 in an alternative embodiment, and FIG. 11 is an enlarged partial view of spray ring 500 shown in FIG. 10. Spray ring 500 is also applicable to washing machine 10 (shown in FIG. 1) in lieu of spray ring 100. Spray ring 500 includes a plurality of nozzles 540 arranged thereon, a ring-shaped channel 510 defined therein, and an inlet 502 in flow communication with channel 510. It should be understood that the pattern of nozzle distribution on spray ring described above is also applicable to spray ring 500, and that the angles of nozzle described above is also applicable to nozzles 540.

Similar to channel 210 (Shown in FIG. 7) of spray ring 200, channel 510 also includes a rib 512 formed in the channel 510 and at an opposing end of inlet 502. But unlike rib 212 (Shown in FIG. 7) in channel 210, rib 512 only blocks equal or less than 80% area of the cross section area of channel 510. Channel 510 further includes a wedge-shaped baffle 514 formed in channel 510 and is adjacent to inlet 502. Specifically, baffle 514 is formed between inlet 502 and neighboring nozzle 540, and constricts approximately 25% to approximately 40% of the cross sectional area of channel 510. More specifically, baffle 514 is formed substantially halfway between inlet 502 and neighboring nozzle 540, and constricts approximately 40% of the cross section area of channel 510. Although water may flow both in two directions in channel 510, and that water in channel 510 flowing with or against the direction of outflow of different nozzles 540 may result in a variation of flow rate in nozzles 540, baffle 514 by partially blocking channel 510 helps to even flow rates in different nozzles 540. Therefore, although water flows in both two directions in channel 510, baffle 514 partially blocks channel 510 to facilitate obtaining an acceptable rinsability. In another embodiment, channel 510 also includes wedge-shaped baffle 514 partially blocking channel 510, but rib 512 formed in the channel 510 is removed. Such configuration also helps to obtain a good rinsability, and water is flowable in both directions in channel 510.

Figure 12:
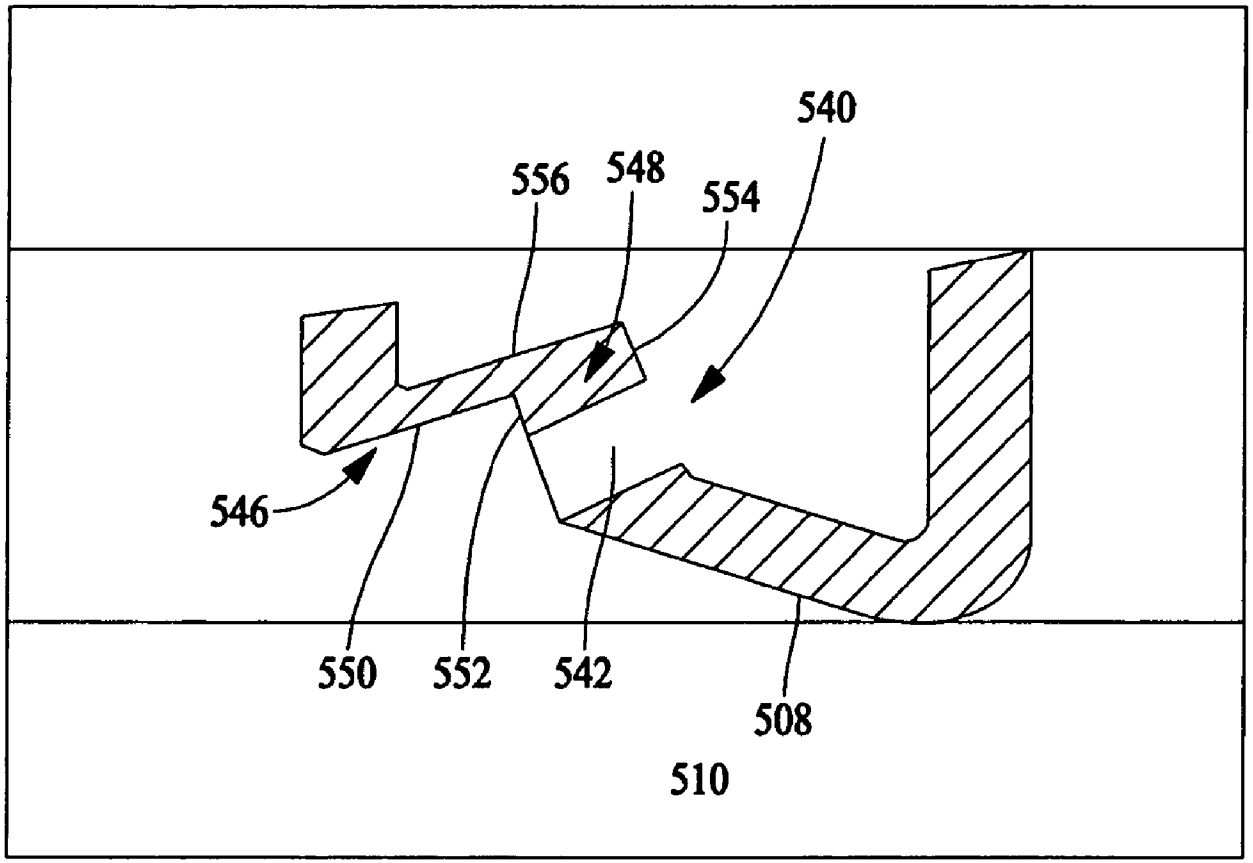
FIG. 12 is a cross sectional view of a nozzle applicable to spray ring shown in FIGS. 10 and 11.
Figure 13:
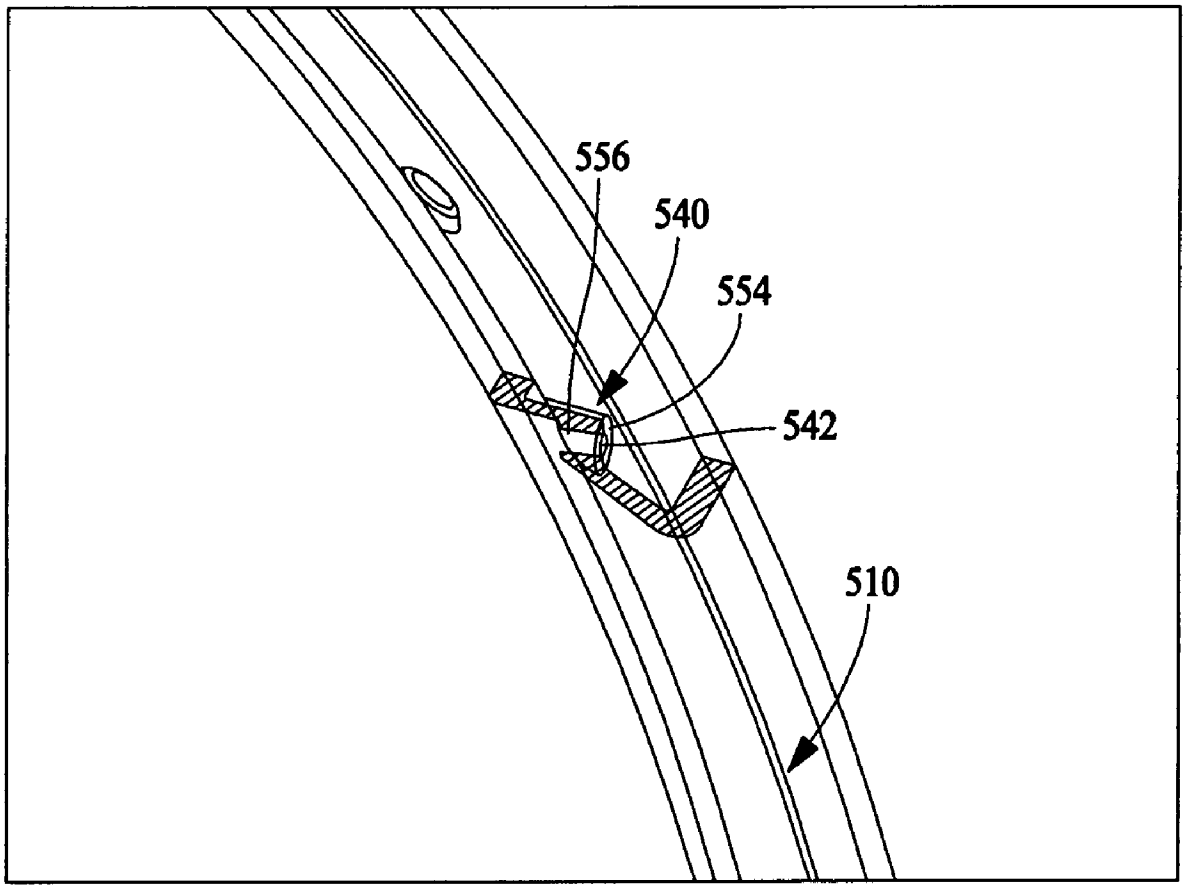
FIG. 13 is a perspective takeaway view of the spray ring with the nozzle shown in FIG. 12.

FIG. 12 is a cross sectional view of nozzle 540 applicable to spray ring 500 shown in FIGS. 10 and 11, and FIG. 13 is a perspective takeaway view of spray ring 500 with nozzle shown in FIG. 12. Nozzles 540 is formed inside outer surface 508 of spray ring 500, such that nozzles 540 will not snag laundry in basket 32 (shown in FIG. 1) during rotation basket 32. Each nozzle 540 includes a cylindrical cutout 546 defined on an outer surface 508 of spray ring 500, and an at least partially cylindrical protrusion 548 extending into channel 510.

Cutout 546 further includes a circumferential sidewall 550 and a planar exit surface 552 connecting with sidewall 550. An opening 542 is substantially perpendicularly defined on exit surface 552, such that opening 542 is in communication with cut out 546. Opening 542 is coaxially with cylindrical cutout 546, such that sidewall 550 of cutout 546 keeps an equal distance with respect to opening 542. In an exemplary embodiment, the diameter of cylindrical cutout 546 is at least 0.1 inch greater then the diameter of opening 542, which helps to avoid water waste caused by water sprayed out from opening 542 sticking to sidewall 550.

Protrusion 548 further comprises an end surface 554, and an outer surface 556 connecting with end surface 554. Opening 542 extends from end surface 554 and through protrusion 548, and is in flow communication with channel 510. Opening 542 is also coaxial with cylindrical protrusion 548, such that outer surface 556 of protrusion 548 is approximately an equal distance with respect to opening 542. Since water can flow in both directions in channel 510, end faces of some protrusions 548 face water flow in channel 510, and end face of the other protrusions 548 are opposite to water flow in channel 510. Due to cylindrical protrusion 548 extending into channel 510, the length of opening 542 is extended, which helps to water sprayed out from nozzle 540 hit the predetermined position. More specifically, the length of opening 542 is at least 0.09 inch.

Figure 14:
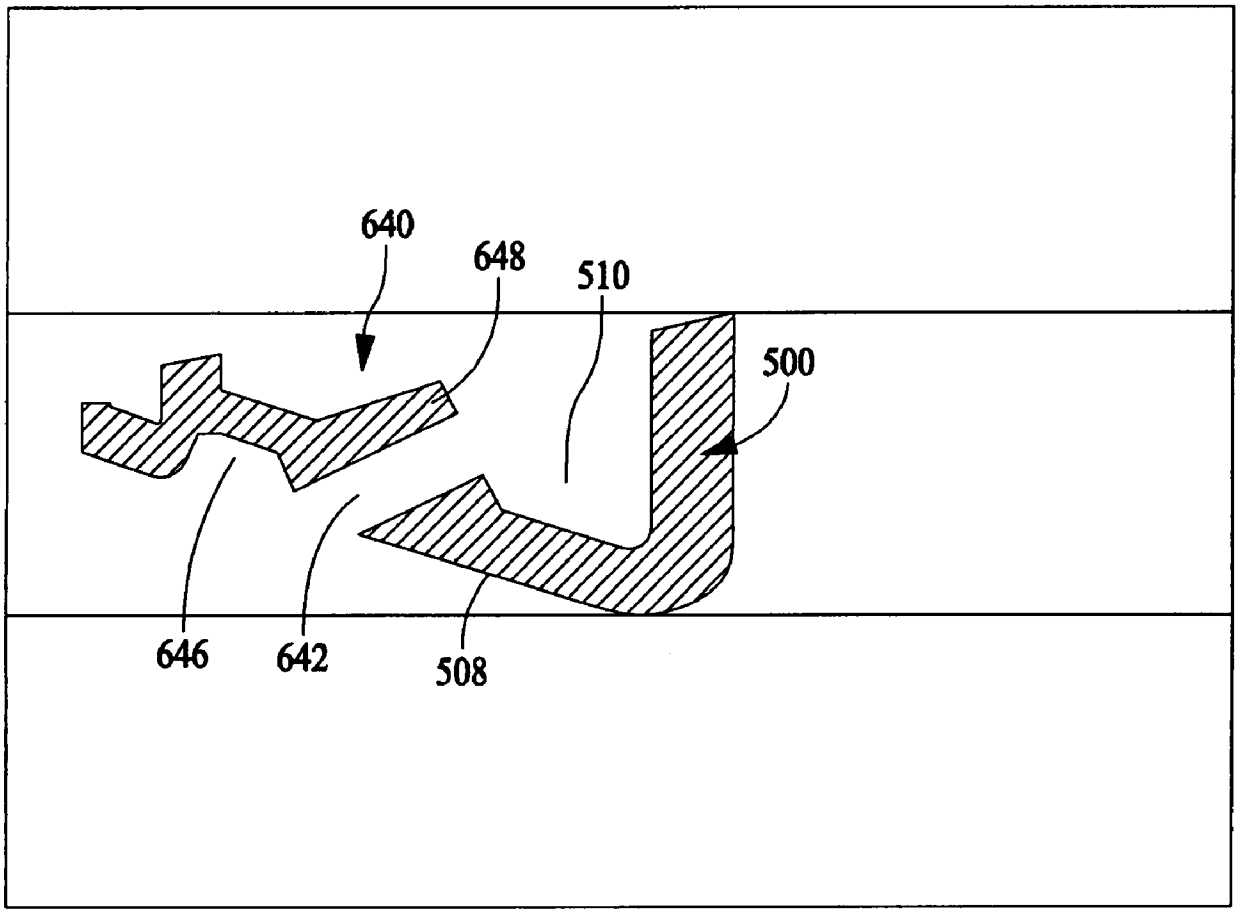
FIG. 14 is a cross sectional view of a nozzle of an alternative embodiment applicable to the spray ring shown in FIGS. 10 and 11.

FIG. 14 is a cross sectional view of a nozzle 640 of an alternative embodiment applicable to spray ring 500 shown in FIGS. 10 and 11. Nozzle 640 is similar to nozzle 540 (shown in FIG. 12), except that nozzle 640 includes a recess 646 in lieu of cutout 546 (shown in FIG. 12) on nozzle 540. Nozzle 640 is also formed inside outer surface 508 of spray ring 500, and nozzle 640 also includes an at least partially cylindrical protrusion 648 extending into channel 510, and a opening 642 is defined within protrusion 648 and in flow communication with channel 510. Recess 646 is defined on outer surface 508 of spray ring 500, and is adjacent to opening 642 and along the direction water sprayed out from nozzle 640. Recess 646 helps to avoid water sprayed out from nozzle 640 sticking to outer surface 508. In another embodiment, water exits nozzle 640 at a velocity at least 4.5 feet per second, which also helps to avoid water sticking.

In operation, a method for operating a washing machine 10 (shown in FIG. 1) in a rinse cycle includes spraying a predetermined quantity of water into basket 32 (shown in FIG. 1) using spray ring 100 (shown in FIG. 1) while basket 32 is rotating at a low speed or basket 32 is stationary, terminating spraying before rotating basket 32 at a high speed, rotating basket 32 at the high speed, and repeating spraying water into basket 32 while basket 32 is rotating at the low speed of rotation or basket 32 is stationary.

When spraying water into basket 32, nozzles 140 arranged on spray ring 100 direct water to a plurality of locations in basket 32, and water valve 104 is used to control the flow rate in spray ring 100. Such that the predetermined quantity of water is determined by the time of spraying and the flow rate controlled by water valve 104. The predetermined quantity of water is also can be determined by a load type or load size. For example, load types include cotton, permanent press, delicate, or bulky items. The load size can be selected from levels such as X small, small, medium, large, and super. In an alternative embodiment, if basket 32 is stationary when spraying water into basket 32, basket 32 is rotated at a low speed after terminating spraying and before rotating basket 32 at a high speed. In an alternative embodiment, if nozzle 340 (shown in FIG. 9) is applied on wash machine 10, basket 32 is rotated at a direction complies with the direction of the nozzles 340 instead of a direction against the direction of the nozzles 340. Such that although nozzles extends outside from outer surface of spray ring, laundry will not be snagged by nozzles. After rotating basket 32 in the high speed, spraying water into basket 32 will be repeated. More specifically, wash machine 10 repeat rinse laundry 3 times to obtain a good rinsability. In an alternative embodiment, if the nozzle distribution pattern shown in FIG. 6 is applied to wash machine 10, when repeating spraying water into basket 32, the flow rate in spray ring 100 can be changed to a different range by altering water valve 120, such as a pulsing valve.

The low speed is selected to be lower than the high speed used to extract water from laundry. Further, the low speed may vary between different washing machine platforms or vary in response to a load within basket 32. In other words, the "low" speed does not refer to a single or discrete speed, and multiple low speeds may be employed in the same washer or different washers. In an exemplary embodiment, the low speed is slow enough not to pin laundry in basket 32 to the sidewall of basket 32.

The methods and apparatus described herein facilitate rinsing the laundry using less water than is required in a known washing machine. Specifically, the spray nozzles described herein facilitate directing an increased quantity of water to the laundry while reducing a quantity of water wasted compared to known washing machines. According, the methods and apparatus described herein facilitate providing cleaner clothes while also substantially reducing a quantity of water consumed to clean the clothes compared to known washing machines. Additionally, the apparatus described herein facilitates avoiding re-circulating rinse water configuration, a considerable amount of additional materials and assemblies are saved, such that the present invention obtains a good rinsability with low water consumption and lower manufactory cost.

While the invention has been described in terms of various specific embodiments, those skilled in the art will recognize that the invention can be practiced with modification within the spirit and scope of the claims.

What is claimed is:

1. A washing machine comprising:

a tub;

a basket rotatably mounted within said tub; and a spraying ring disposed at a top portion of said tub, and comprising a plurality of nozzles arranged in a plurality of groups configured to direct water in a non-vertical flow trajectory, each group of said plurality of groups including a corresponding plurality of nozzles separated by a first distance, said plurality of groups separated by a second distance greater than said first distance, wherein each of said corresponding plurality of nozzles has an opening therein, said openings of said corresponding plurality of nozzles are parallel to each other such that a flow trajectory of water therethrough is substantially parallel to each adjacent nozzle of said corresponding plurality of nozzles within each group, and said spray ring is configured to direct water into said tub through said openings.

2. A washing machine in accordance with claim 1 wherein said plurality of nozzles directs water into said tub in a non-overlapping manner.

3. A washing machine in accordance with claim 1 wherein each of said plurality of nozzles directs water to a location within a space approximately 10 inches upward from a bottom wall of said basket and approximately four inches inward from a sidewall of said basket.

4. A washing machine in accordance with claim 1 wherein said plurality of nozzles direct water into said tub in a non-radial direction with respect to said tub.

5. A washing machine in accordance with claim 1 wherein the opening of each nozzle is defined at an angle between approximately ten and forty-five degrees with respect to a horizontal plan.

6. A washing machine in accordance with claim 1 wherein the opening of each nozzle is defined on an outer surface of said spray ring and at an axis angle greater than approximately 30 degrees with respect to said outer surface.

7. A washing machine in accordance with claim 1 wherein said tub further comprises a tub cover mounted at a top portion there of said spray ring is attached to a lower surface of said tub cover, and said plurality of nozzles is disposed below said tub cover and above said basket.

8. A washing machine in accordance with claim 1 wherein said spray ring further comprises a channel defined within and along said spray ring, and an inlet for directing water into said channel, and said channel is in flow communication with the openings of said plurality of nozzles.

9. A washing machine in accordance with claim 8 further comprising a water valve coupled to said inlet and limiting the flow rate within said channel.

10. A washing machine in accordance with claim 9 wherein the flow rate is with in a predetermined range based on a desired trajectory.

11. A washing machine in accordance with claim 8 wherein a rib is formed within said channel and adjacent to said inlet for blocking said channel, and water in said channel flows in one direction with a direction of the outflow of each nozzle.

12. A washing machine in accordance with claim 11 wherein said rib is formed between said inlet and a neighboring one of said plurality of nozzles.

13. A washing machine in accordance with claim 1 wherein said spray ring is substantially triangular in cross section and comprises an upper half and a lower half engaged with said upper halt said lower half further comprises a board portion extending at an angle between approximately seventeen and approximately twenty-two degrees with respect to a horizontal plane, and said plurality of nozzles is defined on said board portion.

14. A washing machine in accordance with claim 1 wherein said basket is spinning at a speed less than 150 revolutions per minute when said spray ring directs water for rinsing.

15. A washing machine in accordance with claim 1 wherein said basket is substantially stationary when said spray ring directs water for rinsing.

16. A washing machine in accordance with claim 1 wherein said plurality of nozzles comprise extended nozzles.

17. A washing machine in accordance with claim 16 wherein said extended nozzles, each said nozzle having a boss around an entrance thereof.

18. A washing machine in accordance with claim 17 wherein said spraying ring comprises a channel, said washing machine further comprises a pair of parallel baffles positioned in said channel and a rib positioned approximately 180 degrees from an inlet.

19. A washing machine comprising:

a tub;

a basket rotatably mounted within said tub; and a spraying device configured to direct water into said tub, said spraying device having a plurality of substantially equally spaced nozzles arranged in a plurality of groups configured to direct water in a non-vertical flow trajectory and producing non-overlapping water streams which result in a radial target position around said tub, each of said plurality of nozzles having a substantially, circular opening therein, said openings of said plurality of nozzles parallel to each other such that a flow trajectory of water therethrough is substantially parallel to each adjacent nozzle of said plurality of nozzles within each group.

20. A washing machine in accordance with claim 19 further comprising a tub cover covering said tub, said spraying device engaging inside said tub cover.

21. A washing machine in accordance with claim 19 wherein said spraying device comprises twenty-four evenly spaced nozzles at a fixed tangential angle to the basket radial center.

22. A washing machine in accordance with claim 21 wherein said evenly spaced nozzles are arranged such that the water streams can be directed at an approximately ten to thirty degree angle to a horizontal plane.

23. A washing machine in accordance with claim 19 wherein said spraying device further comprises a perforated channel.

24. A washing machine in accordance with claim 19 further comprising a balance ring, said spraying device is arranged over said balance ring.

25. A washing machine in accordance with claim 19 further comprising a water valve coupled to said spraying device to vary a flow rate of water through said spraying device.

* * * * *